US005297998A

United States Patent [19]

Greiner

[11] Patent Number: 5,297,998

[45] Date of Patent: Mar. 29, 1994

[54] BUMPERING DEVICE FOR BOWLING LANES

[76] Inventor: Brian D. Greiner, 3795 Broadway, Cheektowaga, N.Y. 14227

[21] Appl. No.: 897,219

[22] Filed: Jun. 11, 1992

[51] Int. Cl.[5] ..... A63D 5/00; A63D 1/04

[52] U.S. Cl. ..... 473/115

[58] Field of Search ..... 273/37, 51, 54 R

[56] References Cited

U.S. PATENT DOCUMENTS

| | | | |
|---|---|---|---|
| 3,186,712 | 1/1965 | Kessler . | |
| 3,401,933 | 9/1968 | Conklin et al. | 273/57 |
| 4,330,122 | 5/1982 | Sheinberg et al. | 273/51 |
| 4,420,155 | 12/1983 | Sheinberg et al. | 273/51 |
| 4,792,136 | 12/1988 | Dulisse | 273/51 |
| 4,900,024 | 2/1990 | Chandler et al. | 273/37 |

*Primary Examiner*—Vincent Millin
*Assistant Examiner*—William M. Pierce
*Attorney, Agent, or Firm*—Nixon, Hargrave, Devans & Doyle

[57] ABSTRACT

The present invention provides a new and improved bumpering system for guarding the channels (gutters) of a conventional bowling lane. The bowling lane is of the type having a longitudinal bowling lane bed, a pair of elongated channels parallel to and abutting each side of the bowling lane bed, an approach and foul line at one end of the bowling lane bed and a pin deck at the other end thereof. The bumpering device comprises deflection means permanently mounted within the channel, the deflection means having associated therewith extension and retraction means for extending the deflection means to an upright position thereby abutting the bowling lane bed for deflecting bowling balls that may be directed toward the channel and retracting the deflection means to a nested position within the channel thereby permitting bowling balls directed toward the channel to fall thereinto.

16 Claims, 3 Drawing Sheets

BUMPERING DEVICE FOR BOWLING LANES

FIELD OF THE INVENTION

The present invention relates to bowling centers, and in particular, to a new and improved bowling lane bumpering system.

BACKGROUND OF THE INVENTION

Bowling requires a great deal of skill to perfect. Usually after a certain age the skill is developed and enjoyment can be had. However, when a Youngster or physically disabled person bowls on a conventional bowling lane, the ball tends to go into the gutter an unusually large number of times, providing for a low score and less enjoyment.

Bowling lane bumper systems have heretofore been proposed to enhance the score of the individual bowling e.g., young children, the physically handicapped, and may also be used for adults during recreational activities. For example, U.S. Pat. No. 3,401,933 to Conklin et al., discloses a convertible bowling lane which includes a movable means operated by a complex control system, that when extended provides a ball deflection device.

Further examples of bumpering systems for bowling lanes are disclosed in U.S. Pat. Nos. 4,330,122 and 4,420,155 to Sheinberg et al., wherein various deflection devices as taught that are removably disposed in the gutter of a bowling lane for deflecting bowling balls. The devices are conveniently stored when removed from the gutters.

U.S. Pat. No. 4,792,136 to Dulisse, discloses a convertible bowling alley wherein a deflection device is removably disposed longitudinally along both sides of the lane outside the gutters for deflecting a bowling ball rolled down the lane.

U.S. Pat. No. 4,900,024 discloses a bowling alley bumper system wherein elongated bumpers are mounted along side and parallel to each alley gutter and which are provided movable supports that permit the extension of bumpers to guard the gutters when desired and retraction of the bumpers to expose the gutters when normal alley operation is desired.

While the above mentioned bumper systems for bowling lanes may perform effectively, it has been found that the problems of disposing them in the desired locations (i.e. gutters) or blowing them up (in the case of air bag types of bumpers) involves time, trouble and substantial expense which makes these types of bumper systems unsatisfactory. Furthermore, bumpering systems of the type described above are heavy, clumsy to carry and install and require a large amount of storage space. Also, such devices are prone to punctures from loose nails and slivers of wood in the gutters during repeated installation and removal. Accordingly, there is a need for a system that is permanently positioned, does not interfere with normal operation of the lanes and can be automatically employed to the desired position while at the same time being economical and easy to operate.

SUMMARY OF THE INVENTION

The primary object of the present invention is to provide a new and improved bumpering system for a bowling lane.

The present invention provides a bumpering device for guarding the channels of a bowling lane of the type having a longitudinal bowling lane bed, a pair of elongated channels parallel to and abutting each side of the bowling lane bed, an approach and foul line at one end of the bowling lane bed and a pin deck at the other end thereof, the bumpering device comprising deflection means permanently mounted within the channels, the deflection means having associated therewith extension and retraction means for extending the deflection means to an upright active position thereby abutting the bowling lane bed for deflecting bowling balls that may be directed toward the channel and retracting the deflection means to a nested inactive position within the channel thereby permitting bowling balls directed toward the channel to fall thereinto.

In another embodiment, the present invention provides a bowling lane comprising:

a bowling lane bed including an approach and foul line at one end thereof and a pin deck, having a plurality of bowling pins, at the other end thereof;

a pair of elongated channels parallel to and abutting each side of the bowling lane bed, the channels extending from at least the foul line to the pin deck;

deflection means permanently mounted within the channels; and extension and retraction means associated with the deflection means for extending the deflection means to an upright active position thereby abutting the bowling lane bed for deflecting bowling balls which may be directed toward the channel and retracting the deflection means to a nested inactive position within the channel thereby permitting normal operation of the channel.

BRIEF DESCRIPTION OF THE DRAWING FIGURES

DETAILED DESCRIPTION OF THE INVENTION

The present invention provides a new and improved bumpering system for a conventional bowling lane. The novel system of the invention will increase the ease with which bumpers are positioned on the channels of a bowling lane for active use and deactivated for when normal use of the channel is required. As used herein, the term "channel(s)" is synonymous with gutter(s).

The bumpering system of the invention is permanently mounted to the existing channels of the bowling lanes. Therefore, the necessity of additional storage space, as well as the need to continually install and remove the bumpering system is eliminated. Another feature of the present bumpering system is that it enhances the appearance of the existing channel when in the inactive position because being seamless, it hides nails and other objects which may be protruding from the channels, which prevents bowling ball damage caused by the loose nails or splinters in the existing channels. Additionally, the need for electrical outlets, compressors, or the like, which are currently used in conventional type bumpering devices are not necessary.

Figure 1:
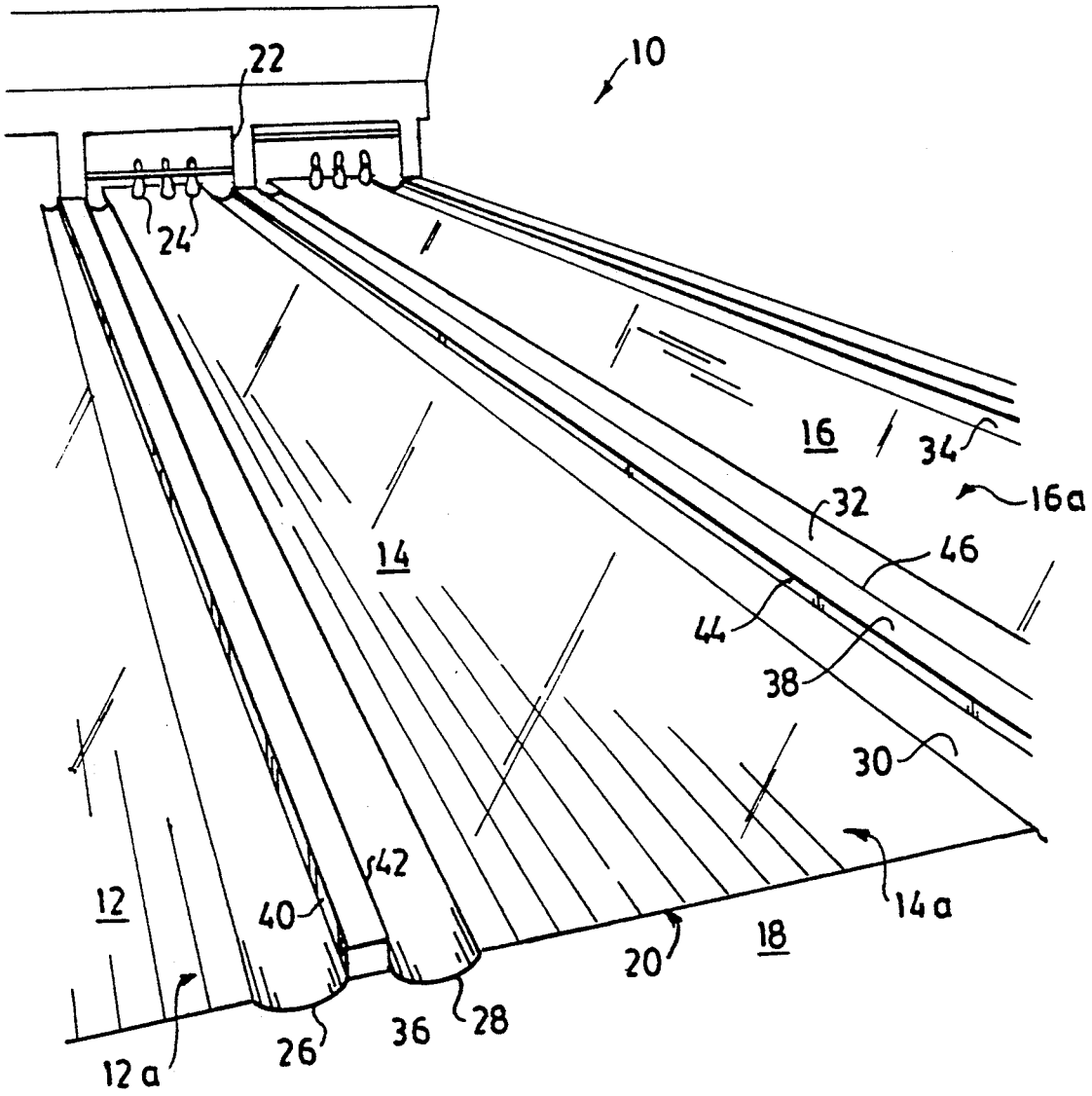
FIG. 1 is a perspective view of a portion of a conventional multi-lane bowling center.

With reference to FIG. 1, there is shown a portion of a conventional multi-lane bowling center, generally designated 10, having bowling lanes or alleys 12, 14 and 16. Bowling lane 16 is seen to be an outside lane, that is, a lane having only one adjacent lane (i.e., lane 14); whereas lane 14 has two adjacent lanes 12 and 16. Each bowling lane 12, 14 and 16 comprises a bowling lane bed 12(*a*), 14(*a*) and 16(*a*), respectively. Each lane bed includes, with reference to lane bed 14(*a*), an approach 18 and foul line 20 at one end thereof and a pin deck 22 at the other end for supporting bowling pins 24.

It is customary to separate adjacent lanes, for example, lanes 12 and 14, with a pair of elongated channels (gutters) such as channels 26 and 28. As indicated, lanes 14 and 16 are separated by channels 30 and 32, and lane 16 being an outside lane only has one channel 34 at the other side thereof. Channels 26, 28, 30, 32 and 34 run parallel to and abut each side of their respective bowling lane beds 12(*a*), 14(*a*) and 16(*a*). Adjacent channels typically are separated by a longitudinal median or guide surface such as guide members 36 and 38 which mark the outer peripheries 40, 42, 44 and 46 of their respective channels. Ordinarily this median or guide member is of sufficient width to provide needed separation between channels for a ball return (not shown).

Typically, the ball return is beneath the bowling lane bed and guide member 36 is a horizontal cap or cover. However, for lanes which provide an above ground ball return, i.e., above the bowling lane bed, guide member 36 comprises a guide channel for returning the bowling ball thereon from the pin deck back to the bowler located at or near approach 18. Similar construction is employed for end lane 16 having a guide member 38 between lanes 14 and 16. The outer channel 34 of lane 16 typically represents the boundary of lane 16.

The present invention provides a new and improved bumpering system which comprises a bumpering device having deflection means permanently disposed longitudinally within the channels. As used herein, the term "within" means that the deflection means is secured in, and conforms to, the shape of the channel in which it is to be installed.

Figure 2:
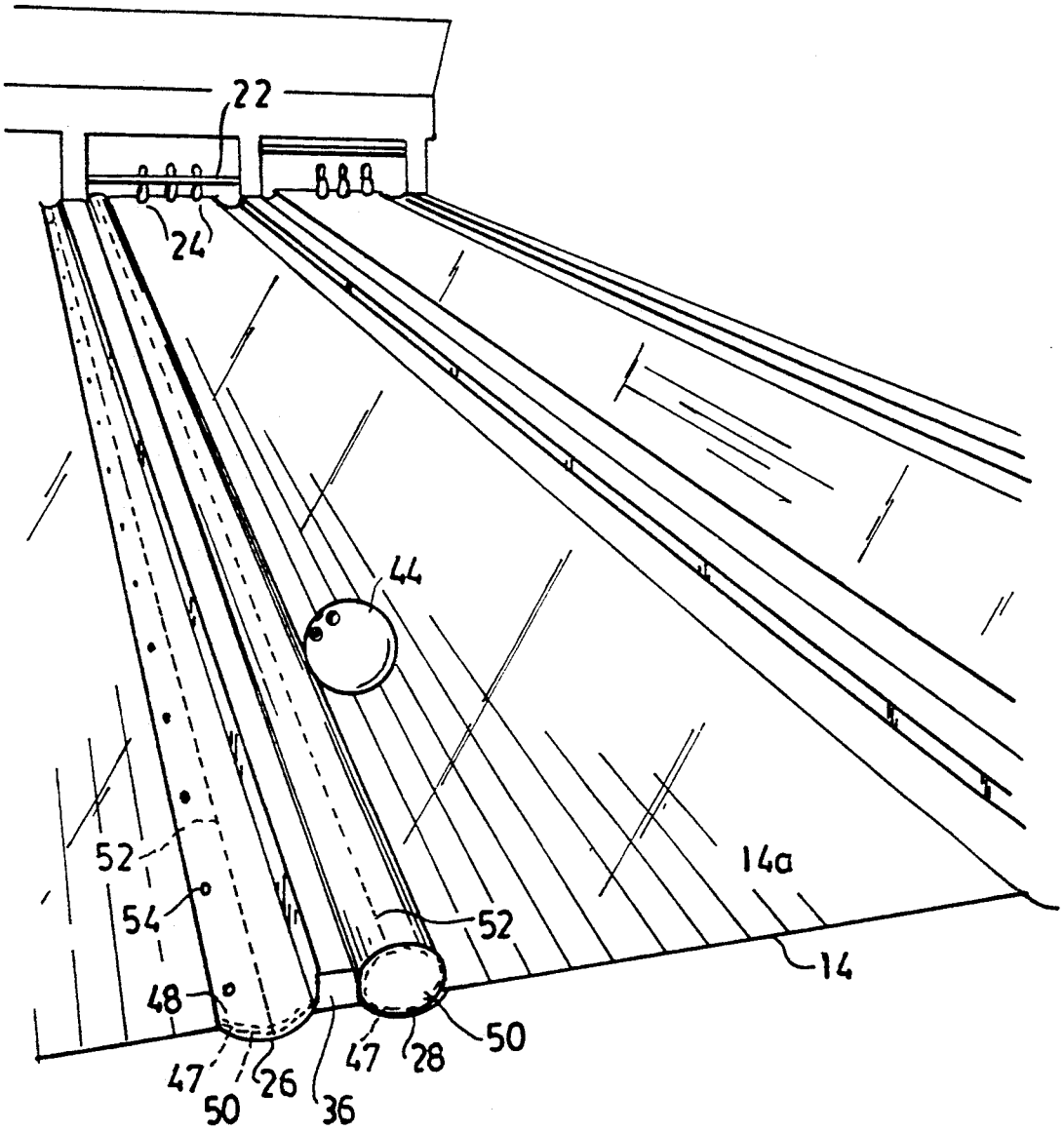
FIG. 2 is a perspective view of the bowling lanes of FIG. 1 fitted with the bumpering device of the present invention.

With reference to FIG. 2, a conventional bowling ball 44 is shown progressing down bowling lane bed 14(*a*) of bowling lane 14 toward bowling pins 24. Bowling ball 44 is in contact with one embodiment of the bumpering system of the invention. Bumpering device 46, shown by the dotted lines, is in an upright active position within channel 28 so as to guard channel 28 and prevent bowling ball 44 from falling therein. Thus, bumpering device 46, when in an extended upright position, as shown in channel 28 (FIG. 2), effectively guards the channel thus warding off balls moving down bowling lane bed 14(*a*) from entering the channel, and directs such balls onward toward pins 24 which are positioned in pin deck 22.

Referring again to FIG. 2, bumpering device 46 is illustrated in a downward inactive position, nested within channel 26. It is understood that channel 26 functions in a normal manner, that is a bowling ball is free to travel down the channel when bumpering device 47 is positioned in an inactive position within the channel. Furthermore, the bumpering device of the invention covers up any loose splinters or nails that could cause bowling ball damage. Additionally, channel maintenance, i.e., sanding and varnishing, is no longer necessary because the bumpering device of the invention lines and thus protects the channel from wear.

Bumpering device 47 of the invention is comprised of a somewhat rigid plastic material that will conform to the channel when in a downward inactive position but possesses sufficient rigidity to remain in an upright active position to deflect a bowling ball away from the channel. Bumpering device 47 can be comprised of any polyester material known in the art such as polyethylene, polypropylene, polystyrene, or the like, or any other suitable material so long as the material possesses the requisite rigidity to remain in an upright position during active use as well as in a downward position within the channel.

Figure 3:
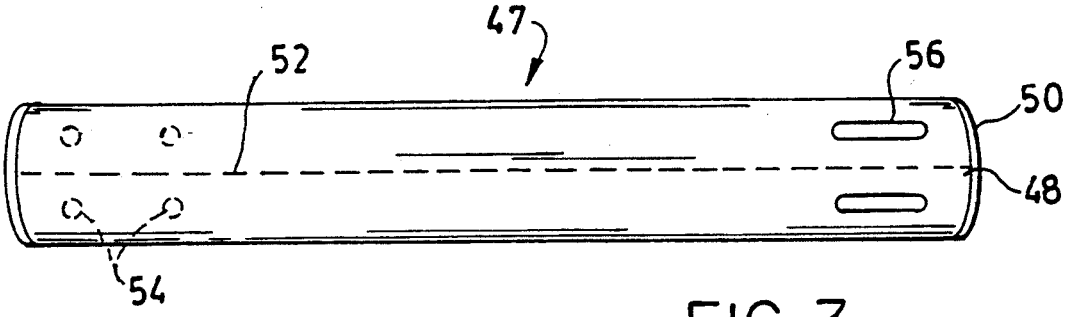
FIG. 3 is a schematic illustration of the bumping device of the invention.

With reference to FIGS. 2 and 3, bumpering device 47 comprises at least two layers of material 48, 50. The layers of material preferably are comprised of a polyester material. Top layer 48 includes a perforated crease or hinge 52 prefabricated therein substantially in the center thereof and along the length thereof, which facilitates movement of the device into an active position as will be discussed hereinafter. The bottom layer 50, or alternatively, both layers 48, 50, can comprise a plurality of slots 52 positioned as needed along the length of bumpering device 47 for installation of the device to the channel. That is, bumpering device 46 is permanently secured within the channel by fastening through slots 54, bottom layer 50 to the channel using any conventional means known in the art, such as, for example, screws, rivets or plastic snaps.

For purposes of illustration only and, not limitation, in a conventional bowling center, channel 28 is typically about 58 feet in length and has a circumference of about 11⅛ inches. Thus, a bumpering device in accordance with the invention to be installed in channel 28, preferably is about 58 feet in length and having a circumference of about 11⅛ inches. Each layer of material is preferably about 50 mils in thickness, but not limited thereto. It is understood that the dimensions of the bumpering system of the invention will vary depending on the particular channel in which it will be installed.

Deployment of the bumpers between their active and inactive positions may be readily accomplished by manually imparting force to top layer 48 of bumpering device 46 in an upward direction until the bumper "pops-up" along perforated crease or hinge 52 into an active position. When in an active position, the bumpering device takes a shape similar to that of a dome within the channel For ease of deployment to an active position, a multitude of hand grips or pull tabs 56, preferably about 1 inch in length, can be incorporated into bumpering device 47 along the length thereof as needed.

Bumpering device 47 can be deployed downwardly into an inactive position, nested within the channel simply by pressing on top layer 48 of bumper device 47 with ones foot or hand and "popping" the bumper back into the channel. Alternatively, a conventional motor gear box (not shown) can be employed to automatically move the bumpering device of the invention into active and inactive positions.

Figure 4:
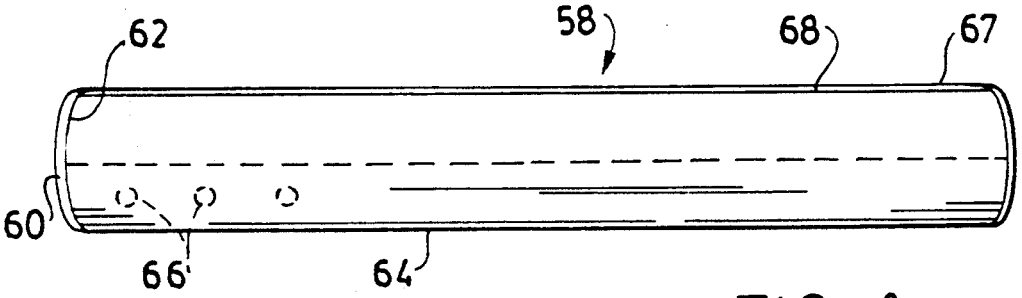
FIG. 4 is a schematic illustration of an alternative embodiment of the bumping device of the invention.

With reference to FIG. 4, there is shown a schematic illustration of an alternative embodiment of the bumpering system of the invention. Bumpering device, generally shown at 58, preferably comprises at least two layers 60, 62 of a polyester material as previously described. However, layers 60, 62 are attached to each other by only one seam 64, in contrast to the embodiment shown in FIG. 3 wherein the layers are attached to each other at both sides. When bumpering device 58 is installed within a channel, the side having seam 64 is positioned in the channel so as to abut the side of the bowling lane bed (FIG. 1). Bumpering device 58 is secured to the channel using the securing means previously described through slots 66 which are preferably positioned within device 58 along the portion of the device which abuts up against the bowling lane bed. Side 68 of the top layer will secure itself up against the guide member or cap 36 (FIGS. 1 & 2) when the device is in an upright active position, thereby remaining in place.

Figure 5:
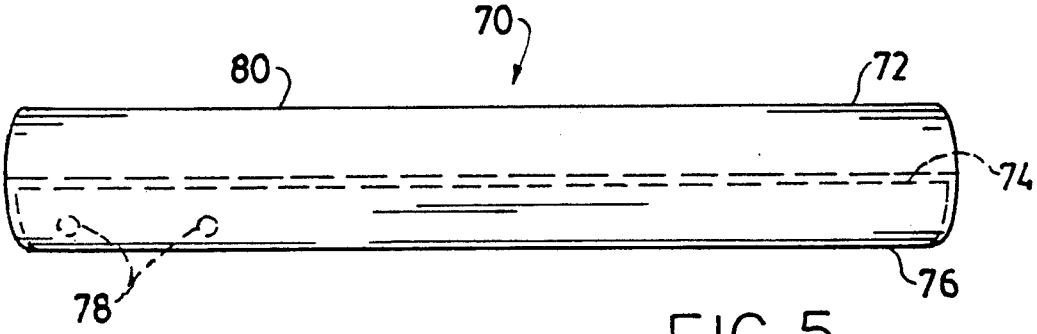
FIG. 5 is a schematic illustration of still another embodiment of the bumping device of the invention.

A yet another embodiment is shown in FIG. 5. Here, the bumpering device, generally designated 70, is comprised of a single polyester layer of material 72 having a tab 74 attached thereto at hinge 76. Tab 74 is positioned along the bowling lane bed when device 70 is installed within the channel, and the device is secured within the channel through slots 78. Side 80 also will remain in place when the device is in an active position by abutting up against the guide member or cap 36 (FIGS. 1 & 2).

It is understood that each bowling lane can be individually conditioned separately for bumper ball operation or normal lane function. Also, each channel can be fully or partially conditioned with the bumpering system of the invention. The foregoing described bumpering device of the invention is extremely simple to install in a bowling lane, provides enhanced effectiveness, is unobtrusive and enhances the appearance of the lanes.

The invention has been described in detail with particular reference to preferred embodiments thereof, but it will be understood that variations and modifications can be effected within the spirit of the invention.

What is claimed is:

1. A convertible bowling channel liner for use in a bowling channel, the bowling channel positioned between a bowling alley bed and a guide member with a lip, said convertible bowling channel liner comprising at least one deformable elongated strip, a means for securing a portion of the strip to the channel and a means for deforming the attached elongated strip from a first configuration that is crescent-shaped in cross-section in which the liner extends above a plane of the alley bed to a second retracted configuration that is crescent shaped in cross-section and is substantially below the plane of the alley bed, whereby in the first configuration a bowling ball is prevented from entering the channel of the bowling alley and in the second retracted configuration the bowling ball is allowed to enter into the channel on top of the liner and travel along it.

2. The convertible bowling channel liner according to claim 1 wherein each said strip in said first position has a substantially concave configuration and in said second position has a substantially convex configuration.

3. The convertible bowling channel liner according to claim 2 wherein said means for securing is selected from the group consisting of screws, rivets and plastic snaps.

4. The convertible bowling channel liner according to claim 2 wherein each said strip is made from polyolefin.

5. The convertible bowling channel liner according to claim 2 wherein each said strip comprises at least two layers, each of said layers having a thickness between about 1 and 100 mils.

6. The convertible bowling channel liner according to claim 2 wherein each said strip comprises a single layer having a thickness between about 20 and 300 mils.

7. The convertible bowling channel liner according to claim 1 wherein each said strip in said first position substantially conforms to the shape of the channel.

8. The convertible bowling channel liner according to claim 1 further comprising at least one hinge on each said strip which extends along at least a portion of the length of each said strip, said hinge facilitates the flexing of each said strip between said first and second positions with said means for deforming.

9. A convertible bowling channel for a bowling alley, the bowling alley including a bowling alley bed and guide member with a lip on each side of the bed, each guide member being separated from and substantially parallel to the alley bed, said convertible bowling channel comprising at least one deformable elongated section, a means for securing a portion of the section to the alley and a means for deforming the attached elongated section from a first configuration that is crescent-shaped in cross-section in which the channel extends above a plane of the alley bed to a second retracted configuration that is crescent shaped in cross-section and is substantially below the plane of the alley bed, whereby in the first configuration a bowling ball is prevented from entering the channel of the bowling alley and in the second retracted configuration the bowling ball is allowed to enter into the channel on top of the liner and travel along it.

10. The convertible bowling channel according to claim 9 wherein each said section in said first position has a substantially concave configuration and in said second position has a substantially convex configuration.

11. The convertible bowling channel according to claim 10 wherein said means for securing is selected from the group consisting of screws, rivets and plastic snaps.

12. The convertible bowling channel according to claim 10 wherein each said section is made from a polyolefin.

13. The convertible bowling channel according to claim 10 wherein each said section comprises at least two layers, each of said layers having a thickness between about 1 and 100 mils.

14. The convertible bowling channel according to claim 10 wherein each said section comprises a single layer having a thickness between about 20 and 300 mils.

15. The convertible bowling channel according to claim 9 wherein each said section in said first position substantially conforms to the shape of the channel.

16. The convertible bowling channel according to claim 9 further comprising at least one hinge on said section which extends along at least a portion of the length of said strip, said hinge facilitates the flexing of each said section between said first and second position with said means for deforming.

* * * * *